United States Patent [19]

Christopher

[11] Patent Number: 4,468,933

[45] Date of Patent: Sep. 4, 1984

[54] PORTABLE COOLER

[76] Inventor: Gary Christopher, 6902 E. Gary Rd., Scottsdale, Ariz. 85254

[21] Appl. No.: 524,932

[22] Filed: Aug. 22, 1983

[51] Int. Cl.[3] ..... F25D 3/08

[52] U.S. Cl. ..... 62/457; 62/464; 383/40

[58] Field of Search ..... 383/110, 38, 40; 62/457, 371, 372, 529, 530, 463, 464; 215/13 R

[56] References Cited

U.S. PATENT DOCUMENTS

| | | | |
|---|---|---|---|
| 497,600 | 5/1893 | Penniston | 383/40 |
| 991,715 | 5/1911 | Good | 62/464 X |
| 1,390,718 | 9/1921 | Lover | 383/40 |
| 1,862,491 | 6/1932 | Hessenbruch | 62/464 X |
| 2,697,465 | 12/1954 | Johnson | 383/40 X |
| 2,775,872 | 1/1957 | Bell | 62/91 |
| 3,085,612 | 4/1963 | Gobel | 383/110 X |
| 3,443,397 | 5/1969 | Donovan et al. | 62/457 |
| 4,050,264 | 9/1977 | Tanaka | 62/457 |
| 4,119,127 | 10/1978 | Klug | 383/40 X |

*Primary Examiner*—Lloyd L. King

*Attorney, Agent, or Firm*—Cates & Roediger

[57] ABSTRACT

A portable cooler has an inner container and an insulated jacket with means for closing the opening to the container. The container is constructed of a heat-conducting material, the outer jacket is provided with one or more pockets, the interior of which communicate with a portion of the heat-conducting wall of the container so that items to be warmed or cooled by the contents of the container may be stored in the pocket. The latter is accessible without opening the container.

20 Claims, 3 Drawing Figures

PORTABLE COOLER

BACKGROUND OF THE INVENTION

This invention relates to portable food and beverage coolers, particularly for personal use in cooling foods and beverages and carrying the same to picnic areas and the like for consumption.

The traditional, commonly-used coolers for foods are the rectilinear, rigid, insulated-wall ice chests, sometimes provided with an inside tray to separate certain foodstuffs from the ice and beverages customarily placed in the bottom of the ice chest. These have the disadvantage of being bulky, heavy and prone to lose substantial amounts of cooling capacity when the large lid is lifted away from the box.

Thermos bottles and larger jugs having spouts are commonly used, and they adequately protect the containers from excessive heat transfer, but they do not provide a means for carrying and cooling foodstuffs.

SUMMARY OF THE INVENTION

I have discovered that I can significantly improve the characteristics of portable coolers by providing a hollow container, which can be of any desired shape. The container has heat conducting walls and an opening of a desired size in some portion of the container.

In combination with the container I provide a heat insulating jacket adapted in size to fit around the walls of the hollow container. The jacket has means for removably covering and insulating the opening in the container.

I provide in the jacket one or more pockets for carrying sundry articles, at least one of the pockets having its inside wall adjacent the heat conducting wall of the hollow container cut away to permit the contents of the pocket to come in intimate contact with the wall of the container, and thereby be adjusted to the temperature of the contents of the container. Preferably the pocket carries a flap which may be adjustably closed and opened.

Certain types of foods which should not come into direct contact with the contents of the container, or for which there is a need for ready accessibility without opening the container (and losing chilled air) are carried in the pocket.

Preferably, I provide, in the means for closing the jacket around the opening in the hollow container, an extension of the jacket which is controlled by a drawstring, whereby the opening in the jacket can be adjusted to permit the insertion of a hand and the removal of a desired object, such as a soft drink can or the like without losing an excessive amount of cooling.

In an especially preferred version, I form the wall of the container at its juncture with the pocket opening to project into the aperture in the pocket to obtain a more intimate contact with the contents of the pocket. I also provide means for carrying the cooler which, in a particular version or embodiment, may be straps attached to the jacket.

My presently preferred shape for the cooler is a hollow cylinder. The cylinder has one opening and the close fitting jacket has an extension of its cylindrical walls such that the drawstring closure can close the end of the jacket around the opening of the cylindrical container.

BRIEF DESCRIPTION OF THE DRAWINGS

Turning now to the drawings in which the presently preferred embodiment of this invention is depicted.

DESCRIPTION OF THE PREFERRED EMBODIMENT

Figure 1:
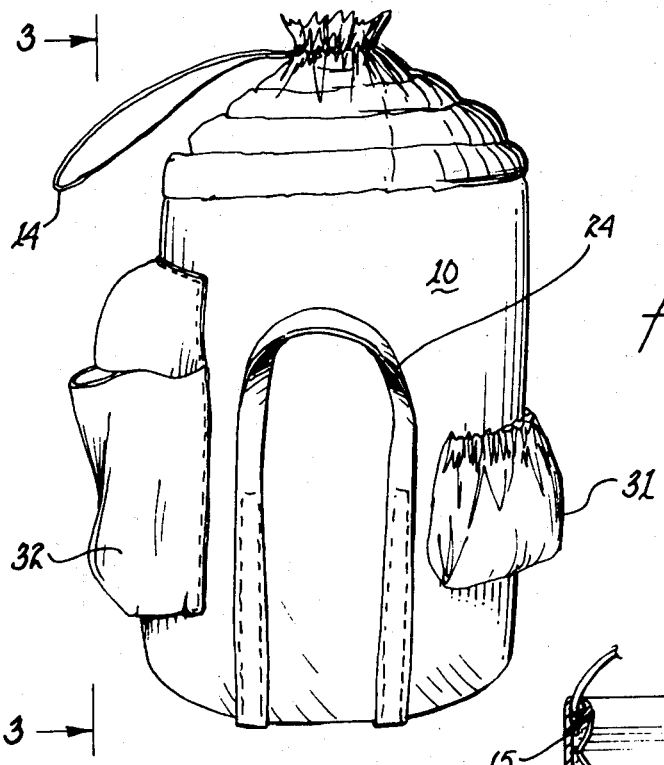
FIG. 1 is an elevational view of a presently preferred embodiment of the invention.
Figure 3:
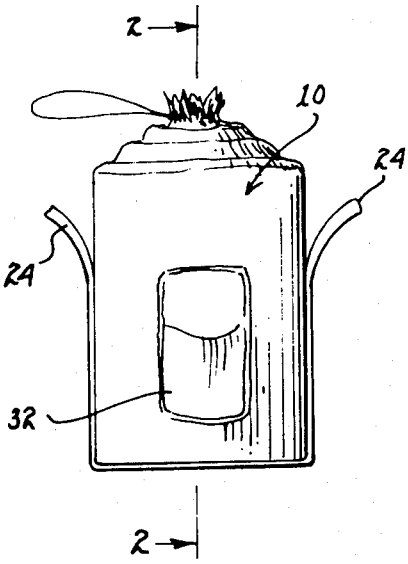
FIG. 3 is a diminished perspective view of the embodiment of FIG. 1 turned ninety degrees from the orientation of FIG. 1.
Figure 2:
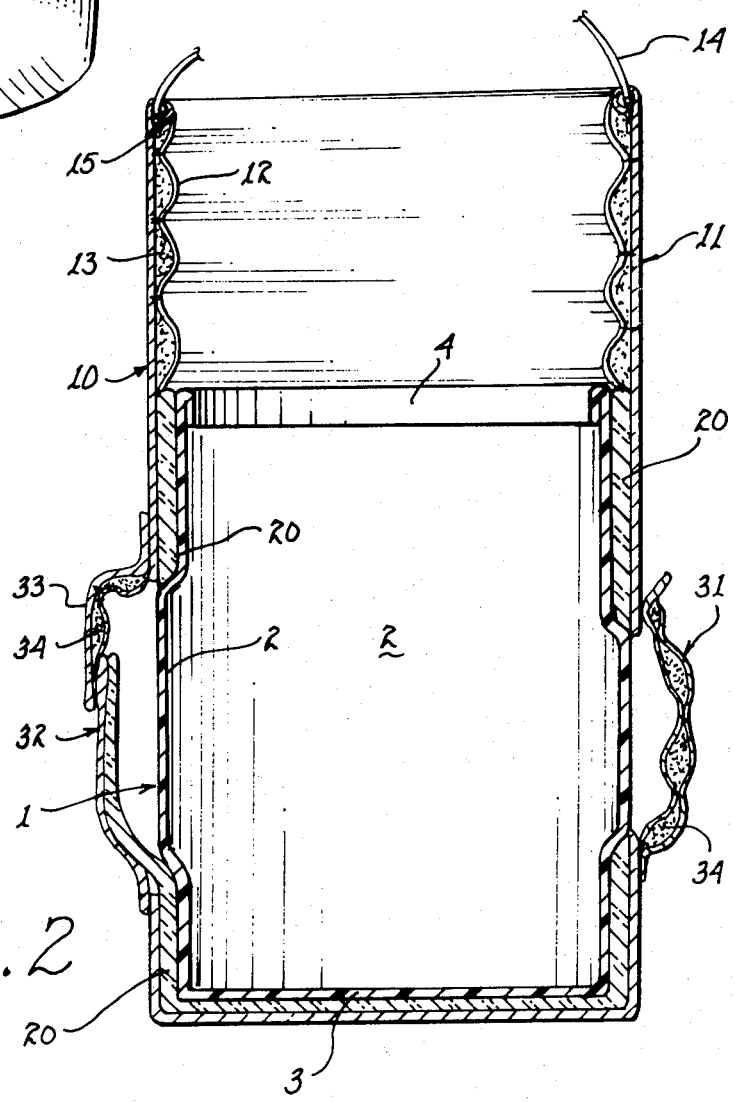
FIG. 2 is the view of FIG. 1, in section, taken along the lines of 2—2 from FIG. 3.

FIG. 2 shows a food and beverage container 1 made out of heat conducting molded plastic of any suitable type. The side walls 2 and closed bottom 3 cooperate to form a hollow cylinder open at the upper end 4. The container is enclosed by a jacket 10 which may be made of any type of heavy thick material such as suede, leather, endura, corduroy, canvas, denim or packcloth. The packcloth is presently preferred. Between the jacket 10 and the container 1 is a layer of cellular foam 20 such as styrofoam, spray foam, polyurethane foam or synthetic foam rubber.

The jacket 10 generally takes the form of a hollow cylinder that fits around the container and the cellular foam casing 20 and is of a sufficient length to extend beyond the opening at the upper end 4 of the container. The extended portion 11 is insulated by sewing an inner lining 12 in tubular rows and filling the tubes 13 with any suitable shredded insulation material. The mouth of the jacket is provided with a drawstring 14 which runs in a tunnel 15. Handles 30 are provided and may be made of any suitable material. In this embodiment the handles are stitched to the jacket, providing a convenient means for carrying the container. Pockets 31 and 32, one or more of which can be adapted to heat transfer between the interior of the pocket and the contents of the container, are provided on the exterior of the jacket 10. Considering pocket 32, by way of illustration, the interior wall of the pocket is removed and replaced by a segment formed by deforming a portion of the wall 2 of the container to project past the cellular foam casing 20, thus to make intimate contact with the contents of the pocket. The insulation for the pocket may be, as in 32, an extension of the cellular foam casing 20 or, as in 31 and in the flap 33 of pocket 32, a double layer of material stitched to form cells 34 which are filled with shredded or granular insulating material.

While a presently preferred embodiment of the invention is shown in the drawing it is to be understood that any number of variations of certain elements of the invention may be made without departing from the spirit of the invention; for example, instead of providing a drawstring in a tunnel, the drawstring may be run through metal grommets spaced intermittently around the perimeter of the jacket opening. A useful alternative to the tunnel closure arrangement could be an insulated lid on the mouth of the container. The shape of the container and the jacket and insulating casing may be varied. The jacket and insulating casing may be of unitary construction. The parts could be made of many choices of material known to be suitable for the purposes.

The scope of the invention is not limited solely to the preferred embodiment depicted herein, but is to be construed by reference to the attached claims.

I claim:

1. A portable cooler comprising an inner receptacle having heat conducting vertical walls and floor and an open top, an insulating member closly fitting the outside surface of said inner receptacle walls and floor; and an outer jacket enveloping said receptacle and insulating member; said insulating member having at least one aperture over said vertical wall, said jacket having pocket means registering with and open to said aperture, and closure means adapted to close said open top and closely fit a human hand as it is inserted empty into the receptacle and as it is withdrawn holding material from said receptacle.

2. The cooler of claim 1 wherein a releasable flap is provided to close said pocket.

3. The cooler of claim 1 with the addition of means for carrying said cooler.

4. The cooler of claim 3 wherein said means comprises straps carried by said jacket.

5. The cooler of claim 1 wherein said container takes the form of a hollow cylinder open at one end.

6. The cooler of claim 5 wherein said closure means comprises a draw string closure, and said jacket carries strap handles for carrying said cooler.

7. The cooler of claim 1 wherein the jacket comprises a two-part layer of cellular insulating material closely fit to the container and an outer fabric jacket.

8. The cooler of claim 1 wherein said closure means comprises a flexible, insulated extension of said jacket disposed in covering relationship to said open top and draw string means for adjusting the size of the opening.

9. The cooler of claim 1 wherein said receptacle has formed in said vertical wall at least one protruding section adapted to register with said at least one aperture and extending to at least substantially the outer surface of said aperture.

10. The cooler of claim 1 wherein said walls of said receptacle are rigid.

11. The cooler of claim 8 wherein said receptacle has formed in said vertical wall at least one protruding section adapted to register with said at least one aperture and extending to at least substantially the outer surface of said aperture.

12. The cooler of claim 8 wherein said walls of said receptacle are rigid.

13. The cooler of claim 9 wherein said walls of said receptacle are rigid.

14. A cooler for personal use comprising a rigid inner receptacle having heat conducting walls and an open top, an insulating member closly fitting the outside surface of said inner receptacle and an outer jacket enveloping said receptacle and insulating member, said insulating member having at least one aperture over said vertical wall, said receptacle having at least one protruding section registering with said at least one aperture, said flexible jacket having pocket means registering with and open to said aperture, and closure means adapted to close said open top and closely fit a human hand as it is inserted and withdrawn to remove materials from the receptacle without significant loss of cooling.

15. The cooler of claim 14 wherein said closure means comprises a flexible insulated extension of said jacket disposed in cover relationship to said open top and has means for adjusting the size of the closure means.

16. The cooler of claim 14 wherein said receptacle has formed in said vertical wall at least one protruding section adapted to register with said at least one aperture and extending to at least substantially the outer surface of said aperture.

17. The cooler of claim 14 wherein a releasable flap is provided to close said pocket.

18. The cooler of claim 14 with the addition of means for carrying said cooler.

19. The cooler of claim 14 wherein said container takes the form of a hollow cylinder open at one end.

20. The cooler of claim 14 wherein the jacket comprises a two-part layer of cellular insulating material closely fit to the container and an outer fabric jacket.

* * * * *